US010314397B2

(12) United States Patent
Stuffel et al.

(10) Patent No.: US 10,314,397 B2
(45) **Date of Patent: *Jun. 11, 2019**

(54) DEVICE AND METHOD FOR FIXING A PUSH ELEMENT

(71) Applicant: PAUL HETTICH GMBH & CO. KG, Kirchlengern (DE)

(72) Inventors: Andreas Stuffel, Bueckeburg (DE); Juergen Weidlich, Roedinghausen (DE); Helmut Meyer, Bueckeburg (DE); Christoph Kursawe, Bissendorf (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/569,145

(22) PCT Filed: May 3, 2016

(86) PCT No.: PCT/EP2016/059888
§ 371 (c)(1),
(2) Date: Oct. 25, 2017

(87) PCT Pub. No.: WO2016/177731
PCT Pub. Date: Nov. 10, 2016

(65) Prior Publication Data

US 2018/0140094 A1 May 24, 2018

(30) Foreign Application Priority Data

May 4, 2015 (DE) ..... 10 2015 106 856

(51) Int. Cl.
*A47B 88/00* (2017.01)
*A47B 88/427* (2017.01)
*A47B 88/407* (2017.01)

(52) U.S. Cl.
CPC ..... *A47B 88/427* (2017.01); *A47B 88/407* (2017.01); *A47B 2088/4272* (2017.01);
(Continued)

(58) Field of Classification Search
CPC ..... A47B 88/427; A47B 88/403; A47B 96/06; A47B 88/407; A47B 88/40; A47B 88/423
(Continued)

(56) References Cited

U.S. PATENT DOCUMENTS 5,588,729 A * 12/1996 Berger ..... A47B 88/427 312/330.1
5,737,820 A 4/1998 Ferrari et al.
(Continued)

FOREIGN PATENT DOCUMENTS

AT 506879 * 12/2009
AT 508 544 A4 2/2011
(Continued)

OTHER PUBLICATIONS

International Search Report of PCT/EP2016/059888, dated Jul. 26, 2016.
(Continued)

*Primary Examiner* — Janet M Wilkens
(74) *Attorney, Agent, or Firm* — Collard & Roe, P.C.

(57) ABSTRACT

A device for fixing a push element, in particular a drawer box to a rail of a pull-out guide, the device comprising a clamping mechanism with a receptacle, into which a web-shaped holding part can be inserted, wherein a self-locking clamping element is provided at the receptacle, by means of which the holding part is secured in a clamping manner against being pulled out. As a result, a particularly stable fixation of the drawer box to a pull-out guide can be achieved.

15 Claims, 11 Drawing Sheets

(52) U.S. Cl.
CPC ..... *A47B 2088/4274* (2017.01); *A47B 2088/4276* (2017.01); *A47B 2088/4278* (2017.01); *A47B 2210/0056* (2013.01); *A47B 2230/0014* (2013.01)

(58) Field of Classification Search
USPC ..... 312/334.7, 223.1, 334.4, 334.5, 348.1, 312/348.2, 334.6, 333; 384/22
See application file for complete search history.

(56) References Cited

U.S. PATENT DOCUMENTS

| | | | | |
|---|---|---|---|---|
| 6,913,334 | B2 | 7/2005 | Weichelt | |
| 8,056,994 | B2 * | 11/2011 | Chen | A47B 88/427 312/334.14 |
| 8,424,984 | B2 | 4/2013 | Ritter | |
| 8,727,460 | B2 | 5/2014 | Grabher | |
| 8,764,136 | B2 * | 7/2014 | Grabherr | A47B 88/427 312/334.27 |
| 8,854,769 | B1 * | 10/2014 | Liang | A47B 88/427 360/125.51 |
| 9,066,587 | B1 * | 6/2015 | Liang | A47B 88/0422 |
| 9,259,087 | B1 * | 2/2016 | Hsiao | A47B 88/0055 |
| 9,808,083 | B2 * | 11/2017 | Lucas | A47B 88/427 |
| 9,986,829 | B2 * | 6/2018 | McGregor | A47B 88/427 |
| 2003/0234603 | A1 * | 12/2003 | Salice | A47B 88/407 312/334.5 |
| 2004/0095047 | A1 * | 5/2004 | Salice | A47B 88/427 312/332.1 |
| 2004/0227440 | A1 * | 11/2004 | Booker | F16F 9/0218 312/334.1 |
| 2008/0218045 | A1 * | 9/2008 | Moser | A47B 88/427 312/333 |
| 2013/0113356 | A1 * | 5/2013 | Salice | A47B 88/0422 312/334.44 |
| 2013/0257244 | A1 * | 10/2013 | Salice | A47B 88/0418 312/319.1 |
| 2014/0015390 | A1 * | 1/2014 | Grabherr | A47B 88/04 312/334.4 |
| 2014/0175965 | A1 * | 6/2014 | Salice | A47B 88/04 312/334.1 |
| 2014/0210330 | A1 * | 7/2014 | Amann | A47B 88/0422 312/334.1 |
| 2014/0314347 | A1 | 10/2014 | Huang | |
| 2015/0147008 | A1 * | 5/2015 | McGregor | A47B 88/0422 384/22 |
| 2016/0025124 | A1 * | 1/2016 | Roedder | F16B 12/04 403/14 |
| 2016/0128476 | A1 * | 5/2016 | Ng | A47B 88/16 312/333 |
| 2017/0105525 | A1 | 4/2017 | Klaus | |
| 2017/0347794 | A1 * | 12/2017 | McGregor | A47B 88/49 |
| 2018/0140095 | A1 * | 5/2018 | Stuffel | A47B 88/427 |
| 2018/0146782 | A1 * | 5/2018 | Boekhoff | A47B 88/427 |
| 2018/0146783 | A1 * | 5/2018 | Stuffel | A47B 88/427 |

FOREIGN PATENT DOCUMENTS

| | | | |
|---|---|---|---|
| AT | 510714 | * | 6/2012 |
| AT | 512748 | * | 10/2013 |
| AT | 518136 | * | 7/2017 |
| DE | 4301327 | * | 8/1993 |
| DE | 696 14 443 | T2 | 5/2002 |
| DE | 20 2004 001 791 | U1 | 5/2004 |
| DE | 20 2009 017 319 | U1 | 5/2011 |
| DE | 202009013706 | * | 5/2011 |
| DE | 20 2010 007 765 | U1 | 11/2011 |
| DE | 202011004588 | * | 7/2012 |
| DE | 10 2011 000 724 | A1 | 8/2012 |
| DE | 10 2013 104 829 | A1 | 11/2014 |
| DE | 10 2013 104 830 | A1 | 11/2014 |
| DE | 102013104829 | * | 11/2014 |
| DE | 21 2013 000 112 | U1 | 12/2014 |
| DE | 10 2014 104 136 | A1 | 10/2015 |
| EP | 606564 | * | 7/1994 |
| EP | 695523 | * | 2/1996 |
| EP | 1 285 604 | B1 | 10/2005 |
| JP | 2004160224 | * | 6/2004 |
| WO | 2007118632 | * | 10/2007 |
| WO | 2009/149479 | A1 | 12/2009 |
| WO | 2010040273 | * | 4/2010 |
| WO | 2010129303 | * | 11/2010 |
| WO | 2011094776 | * | 8/2011 |
| WO | 2012092634 | * | 7/2012 |
| WO | 2014065523 | * | 5/2014 |
| WO | 2014/180899 | A1 | 11/2014 |
| WO | 2015/120493 | A1 | 8/2015 |

OTHER PUBLICATIONS

German Search Report in DE 10 2015 106 8567 dated Mar. 8, 2016 with English translation of relevant parts.
International Search Report of PCT/EP2016/059887, dated Jul. 26, 2016.
German Search Report in DE 10 2015 106 873.7 dated Mar. 9, 2016 with English translation of relevant parts.
International Search Report in PCT/EP2016/059886, dated Jul. 26, 2016.
German Search Report in DE 10 2015 106 855.9 dated Mar. 8, 2016 with English translation of relevant parts.
International Search Report in PCT/EP2016/059890, dated Jul. 26, 2016.
German Search Report in DE 10 2015 106 852.4 dated Feb. 26, 2016 with English translation of relevant parts.
International Search Report in PCT/EP2016/059885, dated Jul. 26, 2016.
German Search Report in DE 10 2015 106 854.0 dated Feb. 29, 2016 with English translation of relevant parts.

* cited by examiner

B - B
A - A
A
B
Hettich
15
17
19
20
22
23
26
27
28
32
40

DEVICE AND METHOD FOR FIXING A PUSH ELEMENT

CROSS REFERENCE TO RELATED APPLICATIONS

This application is the National Stage of PCT/EP2016/059888 filed on May 3, 2016, which claims priority under 35 U.S.C. § 119 of German Application No. 10 2015 106 856.7 filed on May 4, 2015, the disclosures of which are incorporated by reference. The international application under PCT article 21(2) was not published in English.

BACKGROUND OF THE INVENTION

The present invention relates to a device for fixing a push element, in particular a drawer, to a rail of a pull-out guide, said device comprising a clamping mechanism with a receptacle into which a web-shaped holding part can be inserted, wherein a self-locking clamping lever is provided on the receptacle, by means of which the holding part is secured in a frictionally engaged manner against being pulled out, and a method for fixing a push element.

EP 1 285 604 discloses a device for fixing a drawer to a rail of a pull-out guide, in which a base part which can be fastened to the drawer and a latching element which can be fixed to the pull-out guide are provided. In order to compensate for the distance between the guide rails of the pull-out guides, the latching element can be displaced within specific tolerances relative to the base part. The holding forces are limited by the design of the latching element and the base part as a plastic part, especially in the case of heavy drawers which extend in the pull-out direction up to the maximum pull-out position. In addition, it is desirable to position the drawer as precisely as possible within the furniture body in order to obtain an attractive joint pattern.

WO 2009/149479 discloses a device for releasably coupling a drawer to a pull-out guide, in which a holding part and a counter-holding part are connected to one another via a resilient material piece. This leads to a reduction in the positional accuracy in the longitudinal direction. In the lateral direction, the drawer is fixed to the rail by means of a latching device. In the case of the standard stop tests for drawers, in which the drawers are pulled out with load, however, comparatively low holding forces of such a latching connection are obtained.

SUMMARY OF THE INVENTION

It is therefore the object of the present invention to provide a device and a method for fixing a push element in which high holding forces can be provided.

This object is achieved by a device and a method according to the invention as described below.

The device according to the invention for fixing a push element comprises a clamping mechanism with a receptacle, into which a web-shaped holding part can be inserted, wherein a self-locking clamping lever is provided on the receptacle by means of which the holding part is secured in a frictionally engaged manner against pulling out. As a result, a particularly stable securing of the push element can take place by means of the self-locking clamping lever, in particular also with regard to stop tests, in which the drawer is moved into the maximum opening position in the loaded state. The self-locking clamping lever of the clamping mechanism ensures that the holding part is held in such a way that it cannot be pulled out further from the receptacle in the opening direction. However, insertion of the holding part into the receptacle of the clamping mechanism is comparatively simple since only small frictional forces have to be overcome so that assembly can be designed in a simple manner. In addition, a frictionally engaged connection of the clamping lever can be used to effect a stepless fixing of the holding part, which allows particularly precise positioning of the push element in the opening direction.

A frictionally engaged or force-locked connection according to the invention differs from a form-fitting connection in that the holding forces are provided by frictional forces and not by form-fitting abutment elements, such as teeth or stops. In this way, a continuous adjustment can be achieved in the case of a frictionally engaged fixing of the holding part, which is independent of stop elements.

For the frictionally engaged connection, the web-shaped holding part can have a substantially planar surface, which in certain areas is in contact with a contact surface on the clamping lever. The holding part can be strip-shaped, angled, U-shaped, produced as a hollow profile or with other geometries, in particular made of metal, wherein a section of a profile can be used for the frictionally engaged connection. The holding part can also be formed by a section of the pull-out guide profile.

Preferably, the clamping lever is rotatably mounted about a pivot. In this case, the clamping lever can be pretensioned into a locked position, in particular via one or more springs or via an energy storage device.

According to a preferred embodiment of the invention, means for unlocking the clamping lever are provided, by means of which the force-locked connection of the clamping lever can be released from the holding part. A linearly movable slide or button can be provided for unlocking the clamping lever. In this case, the clamping lever can be designed as a two-armed lever, wherein a first arm rests with a contact surface against the holding part, and a second arm can be moved over the means for unlocking the clamping lever. By adjusting the length of the lever arms, appropriate force transmission ratios can be achieved, wherein the contact surface must be moved only slightly away from the holding part in order to unlock the clamping lever.

Preferably, the clamping lever rests on the holding part via a linear contact surface, which extends parallel to the pivot of the clamping lever. The contact surface can be edge-shaped, rounded or designed with a different contact surface to provide high clamping forces. In this clamping system, the high clamping forces are generated by a multiplication of forces by the lever effect.

The clamping mechanism can preferably be secured in a stepless manner to the holding part, so that the drawer is placed on the pull-out guide during assembly and is pushed in slightly, and as soon as the clamping mechanism is fixed to the holding part, the fitter is given the certainty that the drawer is unable to slip inadvertently when it is pulled out of the extension guide in the opening direction. Rather, the clamping mechanism is activated as soon as the holding part is guided past the clamping lever in the receptacle. Subsequent further insertion of the drawer for stepless adjustment is thus easily possible.

For a particularly stable fastening of the drawer, the holding part and the contact surface of the clamping lever resting on the holding part can be made of metal, for example of a steel sheet. In contrast to metal, plastic flows, so that only small forces can be absorbed via the clamping mechanism, wherein the use of plastic materials, in particular reinforced plastics, is certainly possible.

Preferably, the pivot of the clamping lever is arranged in the insertion direction in front of a contact surface of the clamping lever on the holding part. As a result, self-locking is effected, wherein, in the mounted position, an angle between the contact surface of the clamping lever with respect to the pivot can be arranged at an angle to the longitudinal direction of the holding part between 55° and 89°, in particular 70° to 85°. Due to the angular position of the clamping lever, the freewheeling direction and the locking direction are defined in the clamping system. When the holding part is loaded in the blocking direction, a self-reinforcing effect occurs, so that the clamping force also increases with rising loading of the holding part in the blocking direction.

For easy assembly, the receptacle may be formed on a fastening part on which the clamping lever is rotatably mounted. Then the clamping lever can be pre-mounted with the receptacle as a unit on the rail or the drawer. Preferably, the fastening part is displaceably mounted on or in a housing. As a result, the fastening part can be moved relative to the housing via means for lateral adjustment, so that an exact alignment of the drawer is also possible in the horizontal direction perpendicular to the movement direction of the pull-out guide. A height adjustment and/or a depth adjustment can also be provided.

BRIEF DESCRIPTION OF THE DRAWINGS

The invention will be explained below in closer detail with reference to an exemplary embodiment with reference to the attached drawings, wherein.

DETAILED DESCRIPTION OF THE INVENTION

Figure 1:
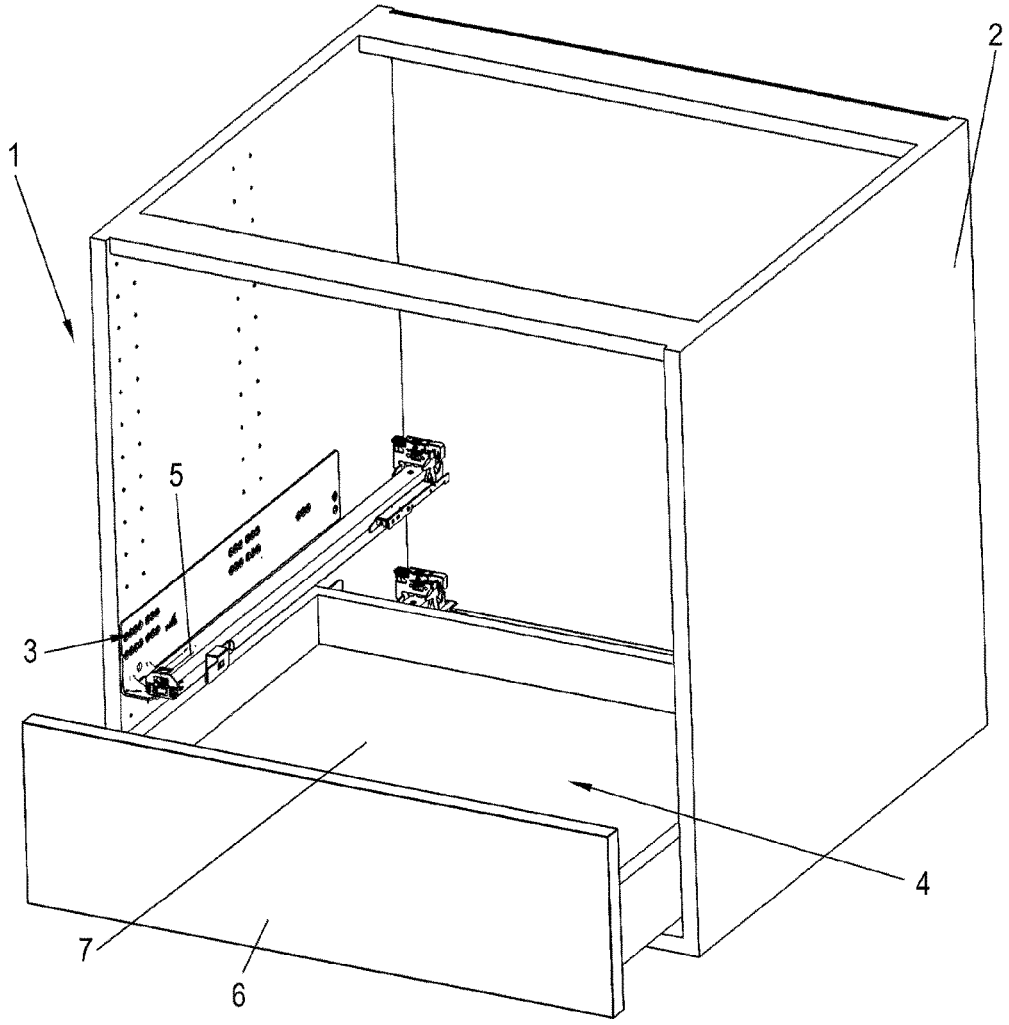
FIG. 1 shows a perspective view of a piece of furniture with a drawer.

A piece of furniture 1 comprises a furniture body 2, on the side walls of which one or more pull-out guides 3 are fixed, each of which has at least one movable rail 5. A drawer 4 is held displaceably on two such rails 5, wherein a device 10 or 10' is provided on each rail 5 for fixing the drawer 4 to the rail 5, as can be seen from the bottom view of FIG. 2. On a bottom 7 of the drawer 4, a first device 10 with lateral adjustment for fixing the drawer 4 is fixed to a rail 5 and a second device 10' without lateral adjustment for fixing the drawer to a rail 5. Each device 10 and 10' comprises a housing 15, which is fixed to a front panel 6 and/or to the bottom 7 of the drawer 4.

Figure 3:
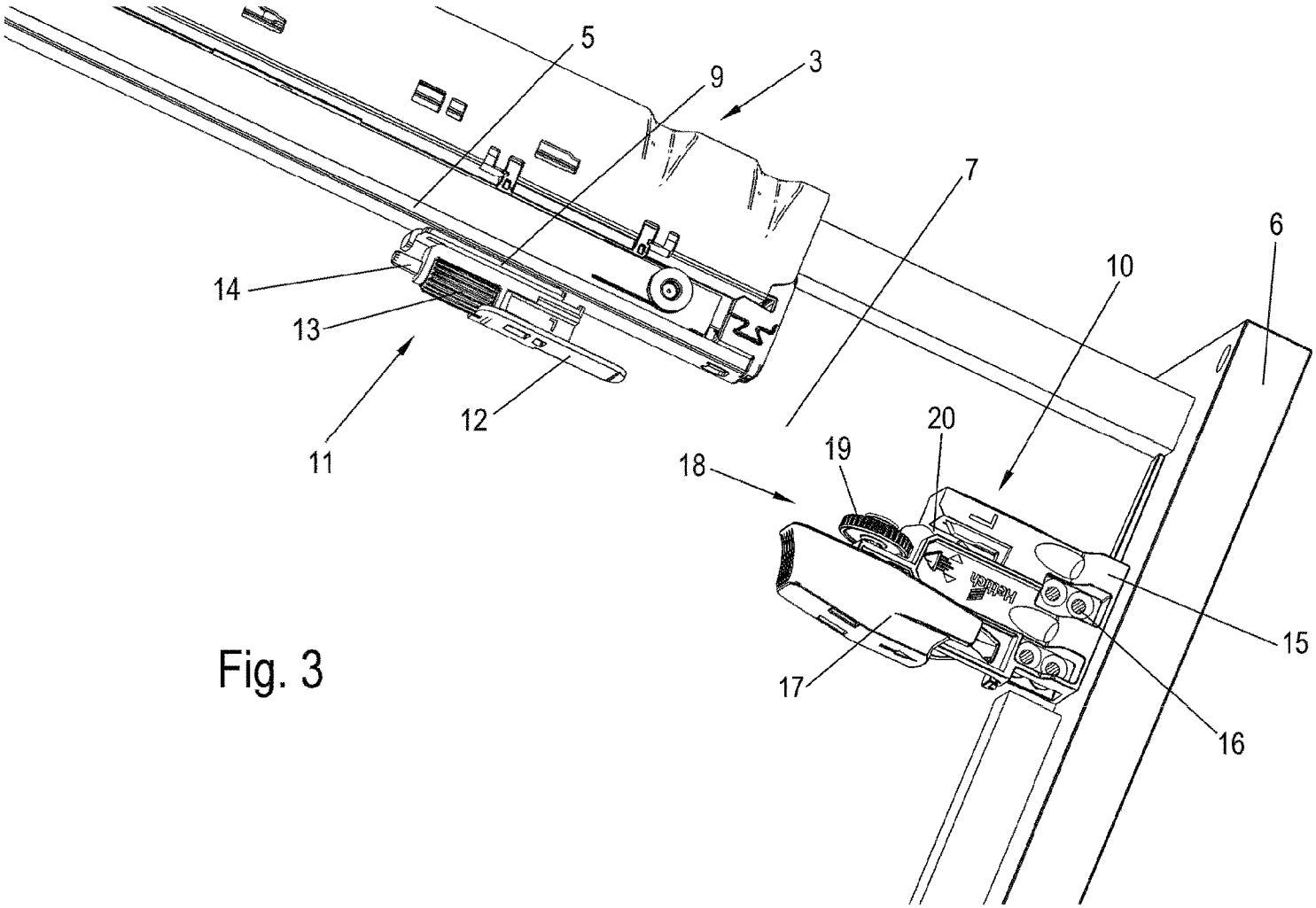
FIG. 3 shows a perspective detailed view of the device according to the invention for fixing the drawer.

In the detailed view of FIG. 3, the device 10 is shown during assembly. The housing 15 can be fixed to the underside of the drawer 4 via fastening means 16, wherein a receptacle 20 is provided for inserting a holding part 12. The holding part 12 is attached to the rail 5 of the pull-out guide 3. In this case, the web-shaped holding part 12 can optionally be fixed to the rail 5 via an integrally formed tab 9, e.g. by welding, or can be fixed to the rail 5 via further components, or the holding part 12 is a part of the rail profile of the rail 5. A device 11 for depth adjustment is provided on the tab 9, which has a rotationally fixed threaded bolt 14 on which a knurled nut 13 is rotatably supported but non-displaceable in the axial direction. As a result, by rotating the knurled nut 13, the threaded bolt 14 can be moved in the longitudinal direction of the rail 5 and thus move a stop which predetermines the insertion depth of the holding part 12 in the receptacle 20. Optionally, such a device 11 for depth adjustment can also be dispensed with.

For assembly, the drawer 4 is placed on the two rails 5 of the two pull-out guides 3 and pushed into the closed position. In this case, a respective web-shaped holding part 12 is inserted at opposite sides into the receptacle 20 of the device 10 or 10' and fixed via a clamping mechanism that secures the holding part 12 in a clamping and frictionally engaged manner against pulling out.

Figure 4:
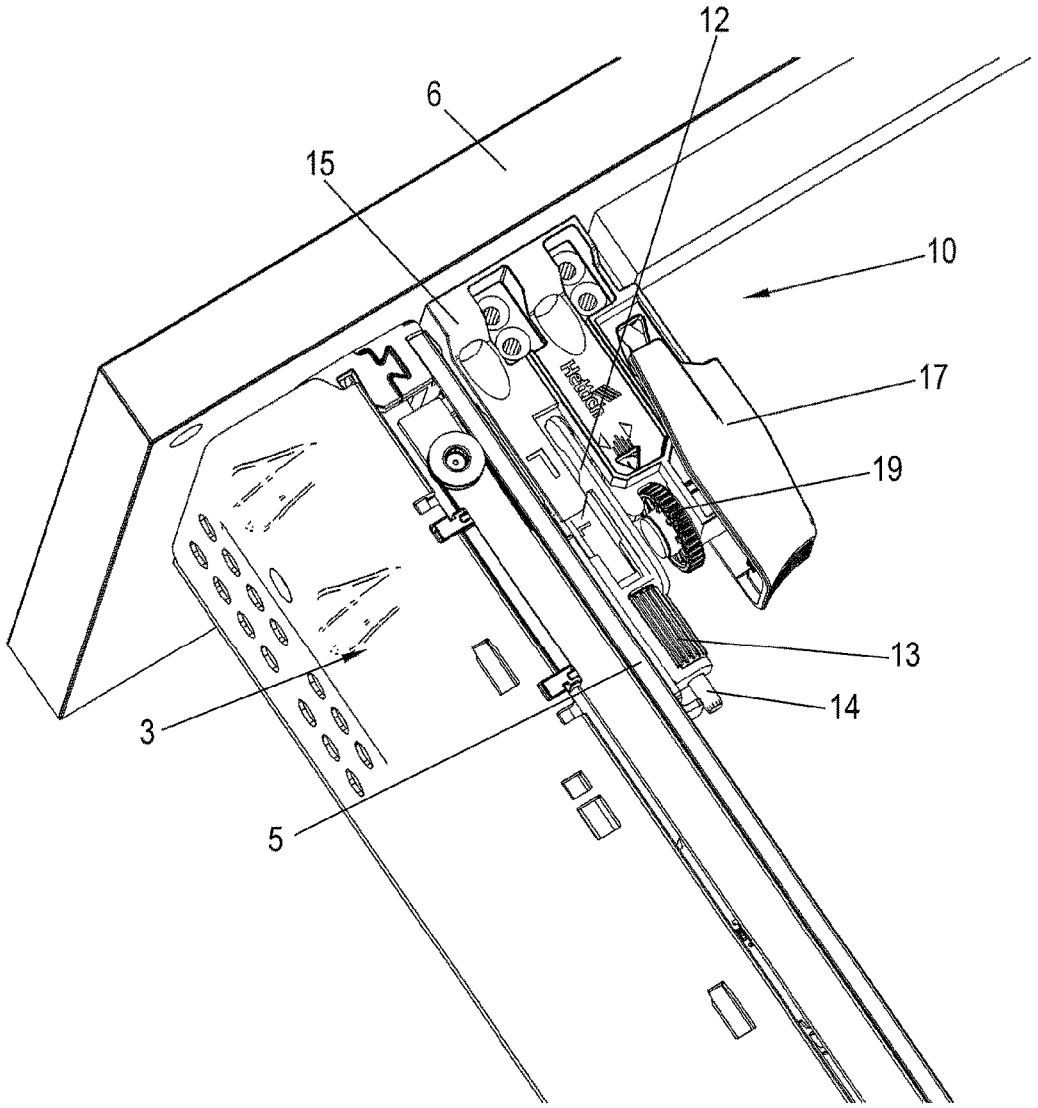
FIG. 4 shows a perspective view of the device of FIG. 3 in the mounted position.

FIG. 4 shows the mounted position of the drawer 4. The holding part 12 has been inserted into the receptacle 20 and secured there against pulling out. The lateral joint pattern can now be adapted via a device 18 for lateral adjustment. The device 18 for lateral adjustment comprises a knurled nut 19 which, by rotating, causes the housing 15 to move laterally in the horizontal direction relative to the receptacle 20 to perform lateral adjustment.

Figure 5:
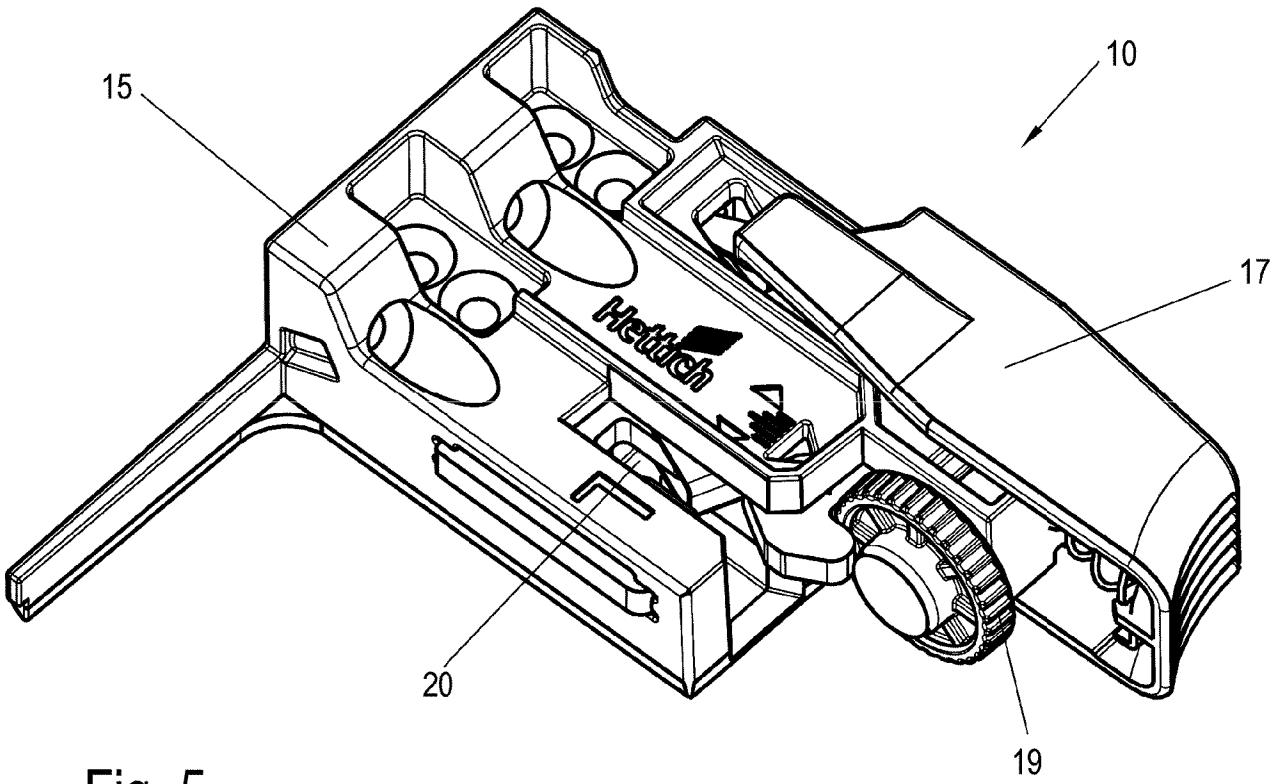
FIG. 5 shows a perspective view of the device without a drawer before assembly.

FIG. 5 shows the device 10 without the holding part 12. The device 10 comprises a slide 17 or button, which is used for unlocking the clamping mechanism. As a result, the drawer 4 can be dismantled again after the assembly by actuating the slide 17.

Figure 6:
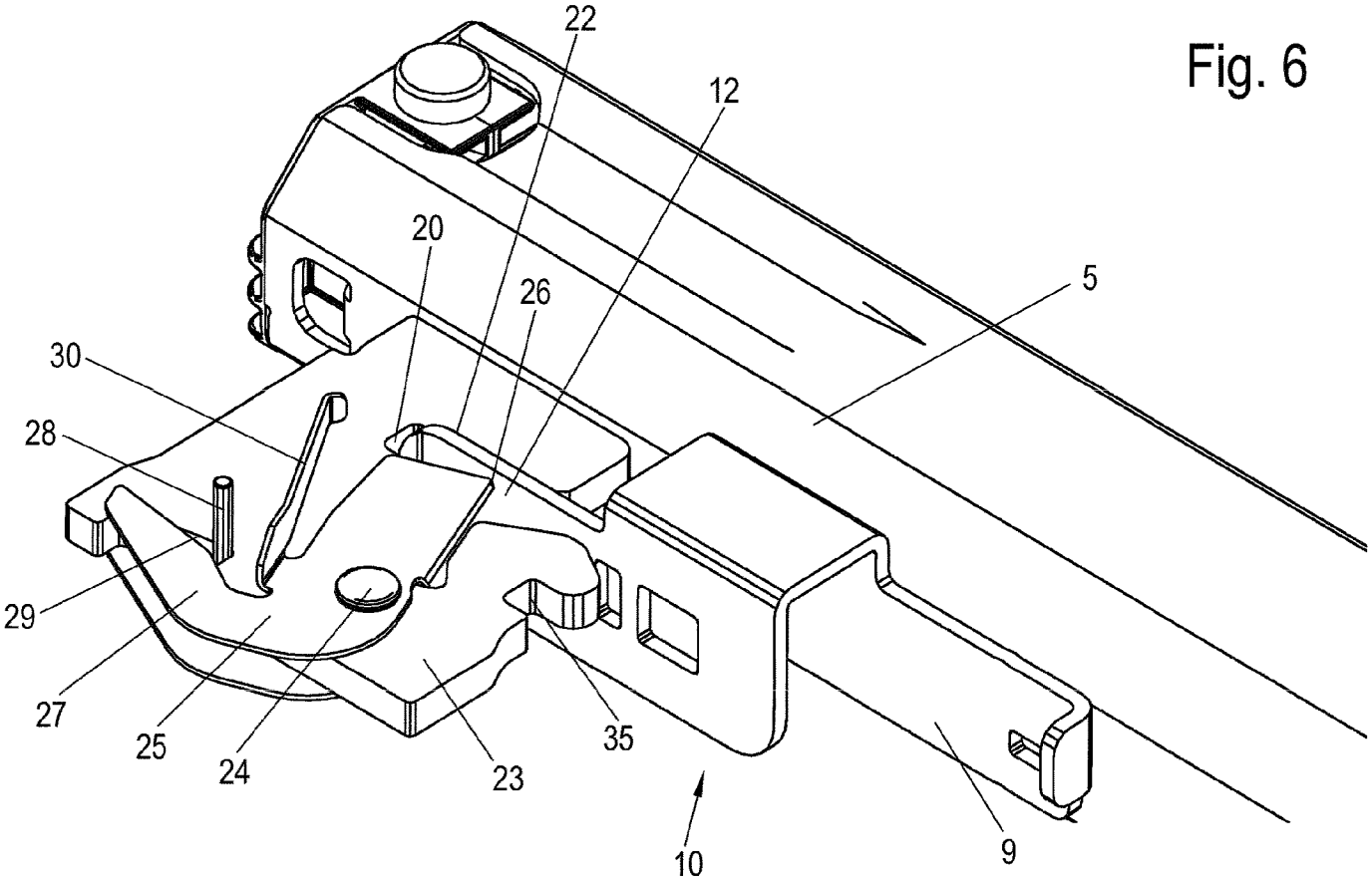
FIG. 6 shows a perspective view of the device without housing during assembly.

FIG. 6 shows the device 10 without the housing 15, but with the holding part 12, which is clamped in the receptacle 20 in a clamping manner.

The clamping mechanism comprises a clamping lever 25, which is rotatably mounted on a fastening part 23 about a pivot 24. The fastening part 23 is of plate-shaped design and forms a side wall 22 of the receptacle 20, which is arranged opposite the clamping lever 25. The holding part 12 is fixed in a clamping and frictionally engaged manner between a contact surface 26 of the clamping lever 25 and the side wall 22 and secured against being pulled out. For this purpose, the pivot 24 is arranged in front of the contact surface 26 in the direction of insertion of the holding part 12 so that the holding part 12, during insertion into the receptacle 20, first passes a plane perpendicular to the insertion direction in which the pivot 24 is arranged before the holding part 12 touches the contact surface 26. The clamping lever 25 is thus designed to be self-locking and, in the case of tensile forces on the holding part 12, the clamping lever 25 with the contact surface 26 is pressed even more strongly against the holding part 12.

The clamping lever 25 is designed as a two-armed lever, wherein the contact surface 26 is formed on one arm for the clamping fixing of the holding part 12, and means for unlocking the clamping lever 25 act on a second arm 27. The clamping lever 25 is designed in the form of an angle and is pretensioned into the clamping position by means of an integrally formed spring 30. In this case, the spring 30 is designed as a leaf spring and is supported on the housing 15.

The means for unlocking comprise a bolt 28 which is slidably formed in a wedge-shaped gap 29 between the arm 27 and the fastening part 23. When the bolt 28 is displaced towards the end of the arm 27, the arm 27 is moved by the wedge-shaped design of the gap 29, and the clamping lever 25 rotates such that the contact surface 26 comes out of engagement with the holding part 12. As a result, the holding part 12 can be easily pulled out after the clamping lever 25 has been turned. The bolt 28 is guided along a side wall of the fastening part 23.

The clamping lever 25 is made in this case from a bent metal plate which engages around a section of the plate-shaped fastening part 23 in a U-shaped manner. The bottom of the U is thereby formed on the contact surface 26, so that a line-shaped contact surface 26 rests against the holding part.

Figure 7:
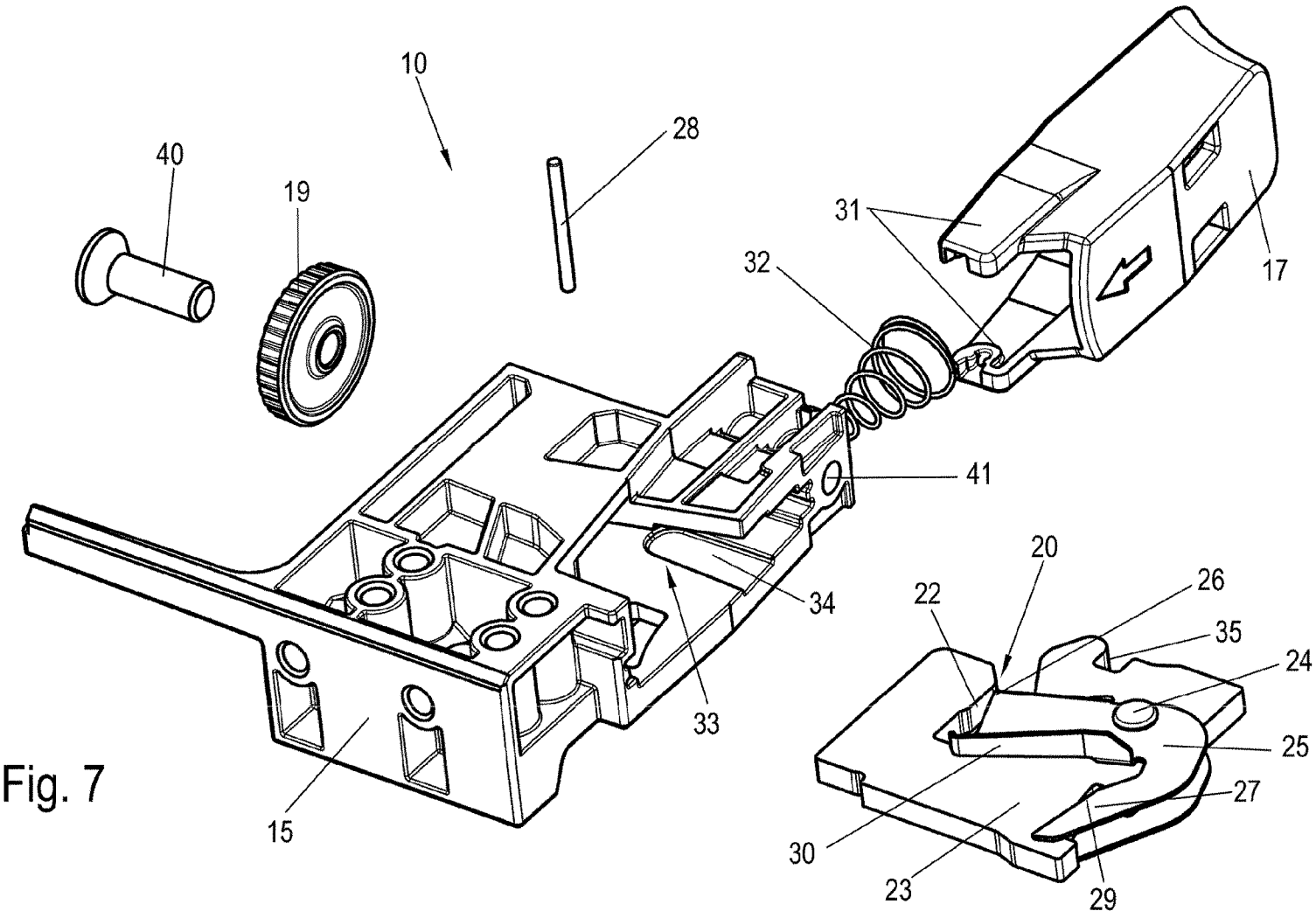
FIGS. 7 to 9 show several views of the device for fixing a drawer without holding part.

FIG. 7 shows an exploded view of the device 10 with the housing 15. A slot-shaped receptacle 33 is provided on the housing 15, on which the fastening part 23 is held displaceably with the clamping lever 25. A head section on the pivot 24 is guided in a groove-shaped guide 34. The fastening part 23 can be guided in the housing 15 via further or other surfaces. Furthermore, the slide 17 is shown, which is designed as a cap-shaped part and holds the bolt 28 between two arms 31. The bolt 28 can be displaced along the wedge-shaped gap 29 by a movement of the slide 17 along the fastening part 23. The slide 17 is thereby pretensioned by a spring 32 into an initial position, in which the bolt 28 does not unlock the clamping lever 25. Unlocking of the clamping lever 25 is effected only by shifting the slide 17 against the force of the spring 32.

Furthermore, the device 18 for lateral adjustment is shown, in which a threaded bolt 40 engages a threaded bore 41. A knurled nut 19 is fixed on the threaded bolt 40, wherein one edge of the knurled nut engages in a U-shaped receptacle 35 on the fastening part 23. By rotating the knurled nut 19, the fastening part 23 can thus be displaced relative to the housing 15 in the longitudinal direction of the threaded bolt 40, i.e. in a plane parallel to the front panel 6 of the drawer 4.

Figures 8A, 8B, 8C:
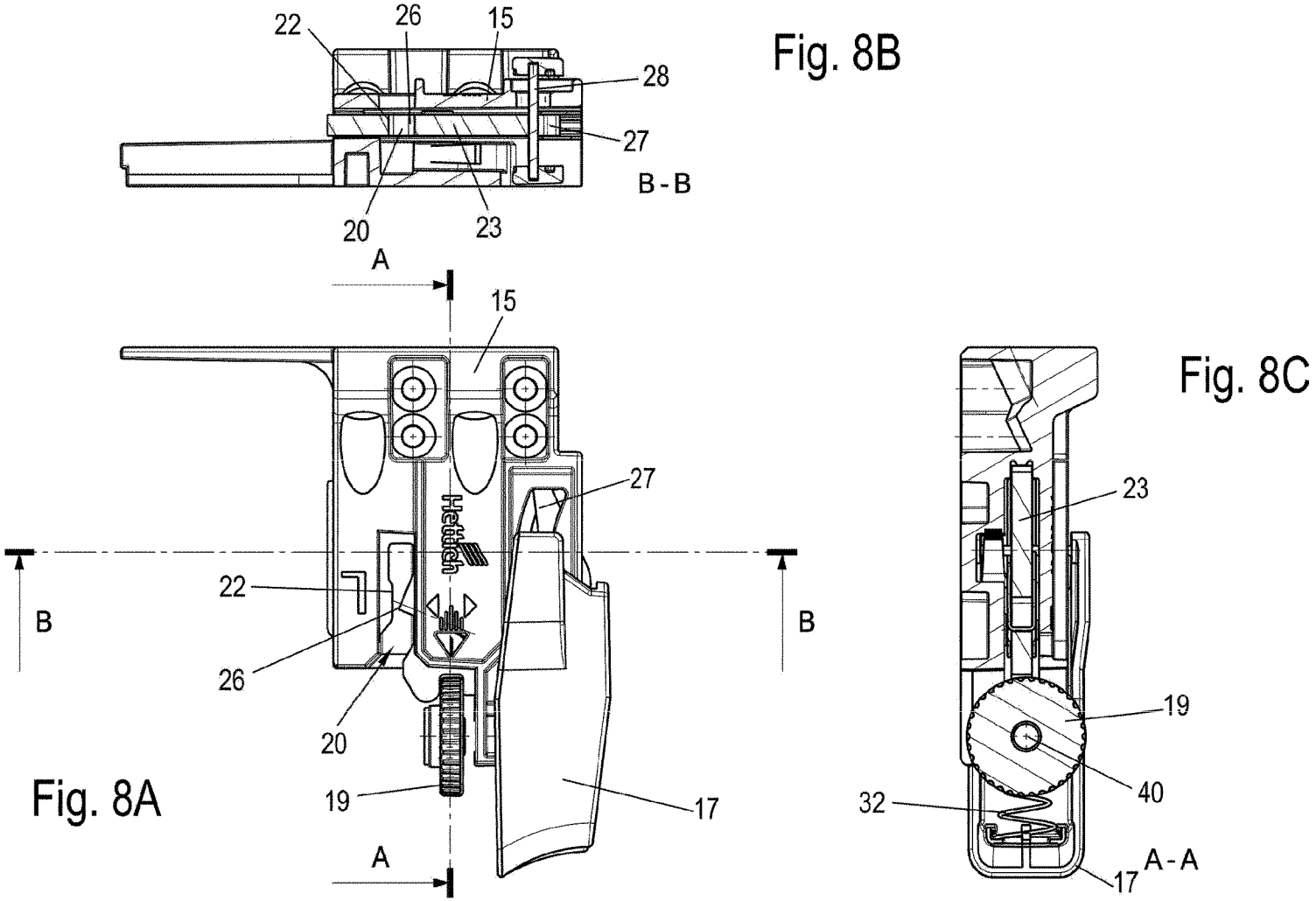

In FIGS. 8A to 8C, the device 10 with the housing 15 is shown in detail. The plate-shaped fastening part 23 is slidably mounted within the receptacle 33 of the housing 15 and in turn itself supports the clamping lever 25 via the pivot 24. The slide 17 engages around the housing 15 in a U-shaped manner and is linearly guided in order to pivot the clamping lever 25 for an unlocking process by displacement.

Figure 9:
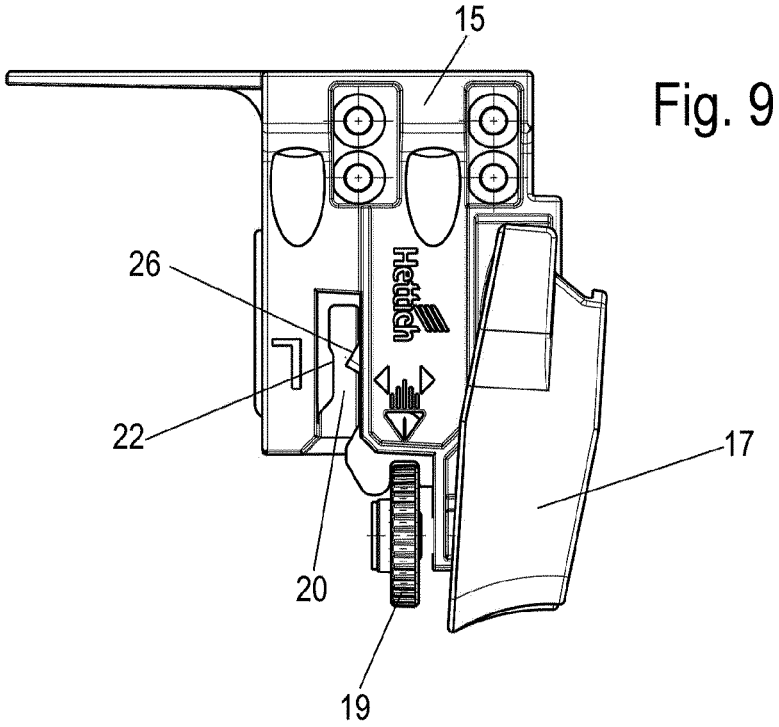

In FIG. 9, the device 10 is shown in an unlocking position, in which the slide 17 has been pushed onto the housing 15. The pin 28 thus moves the clamping lever 25 so that the contact surface 26 moves slightly away from the opposing side wall 22 so that a holding part 12, which is arranged between the side wall 22 and the contact surface 26, can be pulled out of the receptacle 20. The movement of the contact surface 26 can be in a range between 0.02 to 4 mm, in particular 0.4 mm to 2 mm.

Figure 10:
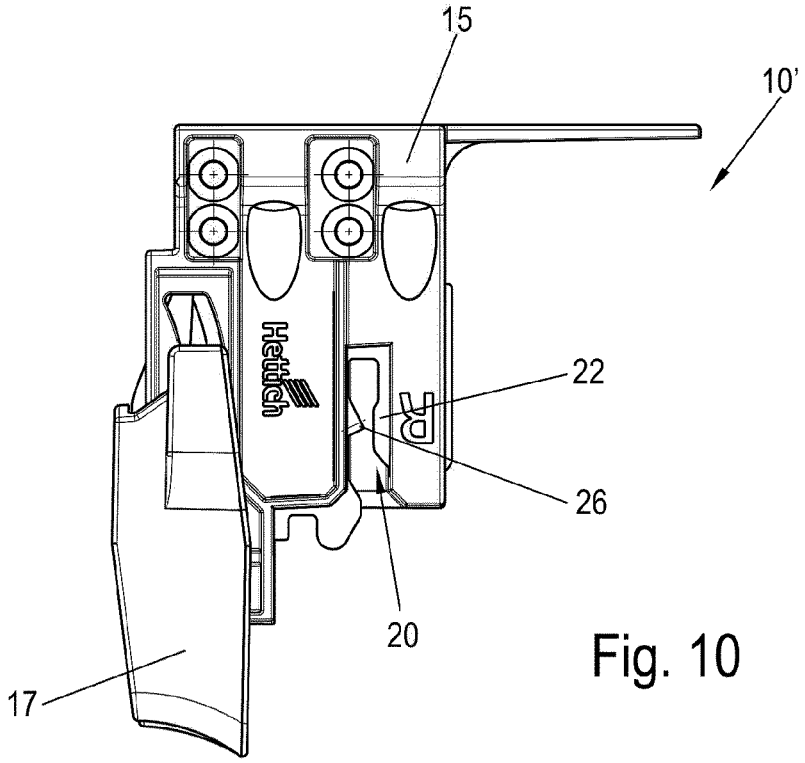
FIG. 10 shows a view of a modified device for fixing a drawer without lateral adjustment.

FIG. 10 shows the device 10', which is designed like the device 10, but without the device 18 for lateral adjustment. In this respect, the knurled nut 19 and the threaded bolt 40 are missing. Apart from that, the device 10' can be designed in a structurally identical or mirror-symmetrical manner to the device 10. The fastening part 23 can be movably mounted in the housing 15, so that the device 10' forms a floating bearing, whereas on the opposite side a fixed bearing is provided which positions the drawer 4 within the furniture body 2 in the horizontal lateral direction.

Figure 2:
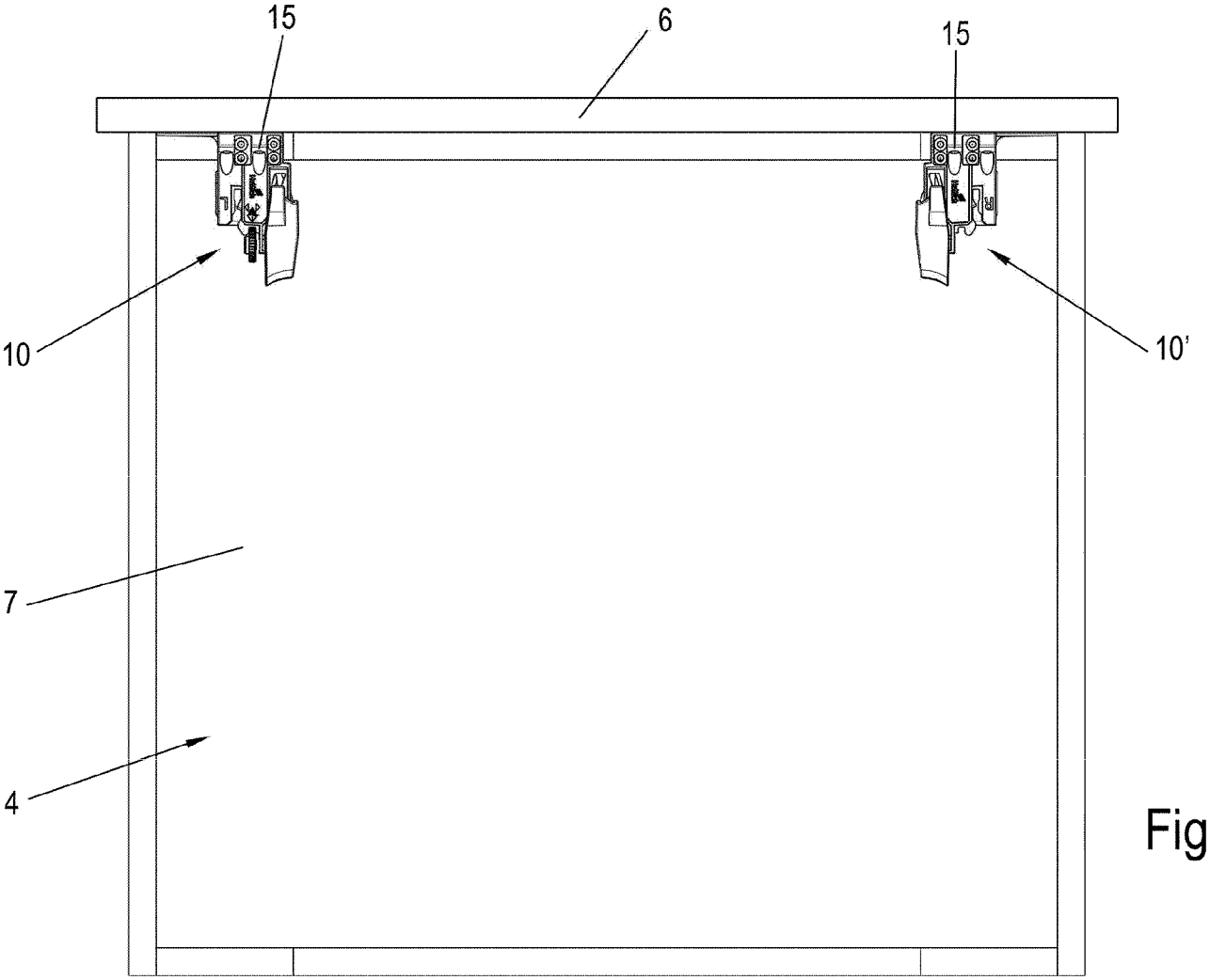
FIG. 2 shows a bottom view of the drawer of FIG. 1.
Figure 11:
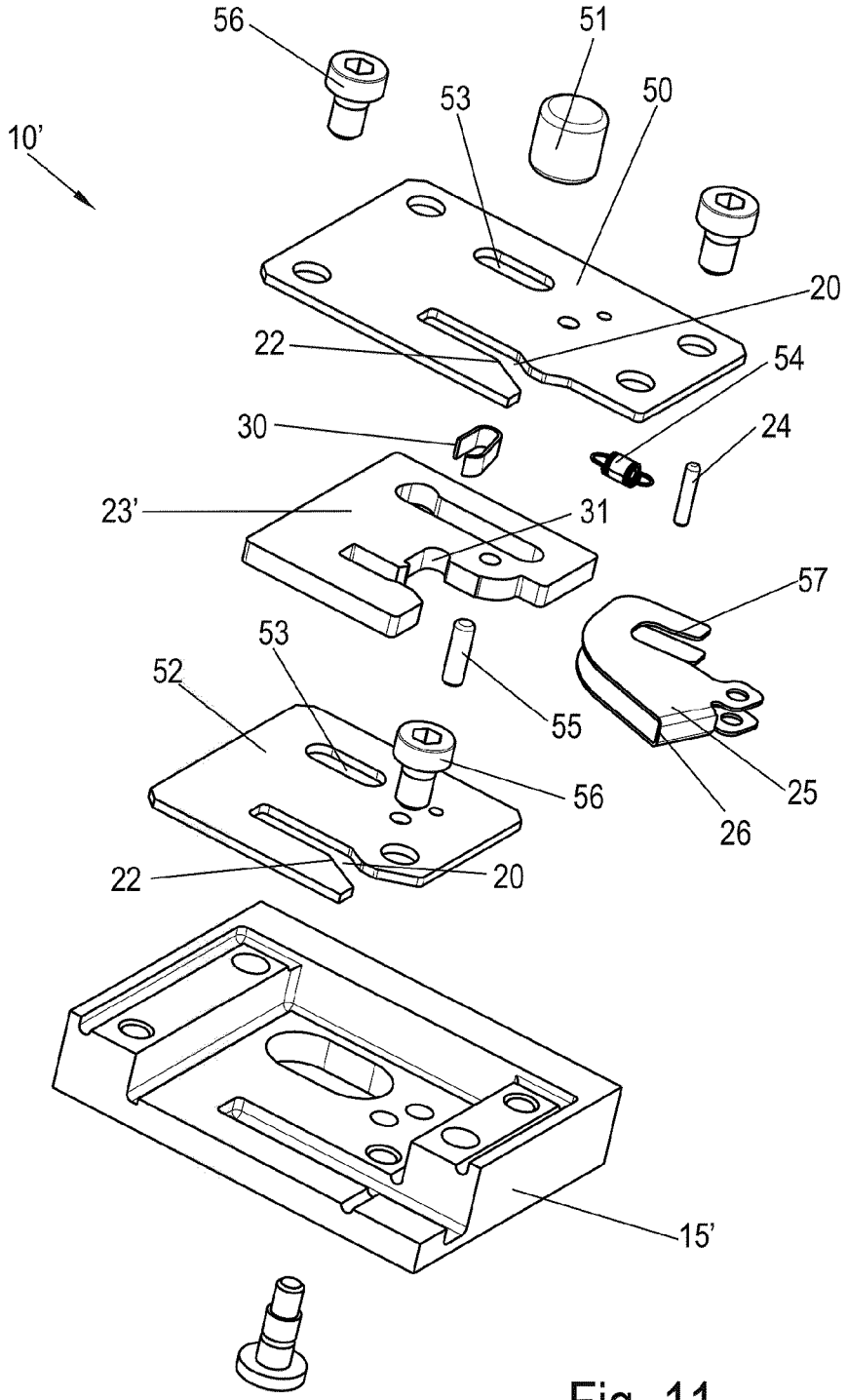
FIG. 11 shows an exploded perspective view of a modified device without holding part.

FIG. 11 shows a modified device 10", by means of which a web-shaped holding part 12 shown in FIG. 2 can be secured in a clamping manner. The device 10" comprises a housing 15' on which an outer plate 50 and an inner plate 52 are arranged. The plates 50 and 52 are provided with a slit-shaped receptacle 20, in which a side wall 22 is arranged on one side, and a clamping lever 25 is rotatably mounted on the opposite side about a pivot 24. As a result, the web-shaped holding part 12 can be displaced in a force-locked manner between a contact surface 26 on the clamping lever 25 and the side wall 22. On the plates 50 and 52, elongated holes 53 are further formed, which serve to guide a bolt 56 which is connected to the slide 51. In this case, the slide 51 is pretensioned into a starting position by a spring 54, wherein the spring 54 is fixed on the slide 51 on the one hand and with the pin 55 on the plate 50 on the other hand.

The clamping lever 25 comprises an actuating arm 57, which can cooperates with the slide 51.

A receptacle 31 for inserting a spring 30 is also provided on the plate-shaped mounting part 23', which spring is designed as a leaf spring and acts on the clamping lever 25 to pretension the latter into the locked position.

Figure 12A:
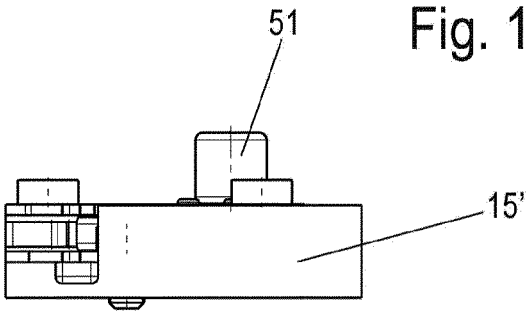
FIGS. 12A to 12C show several views of the device of FIG. 11.
Figure 12B:
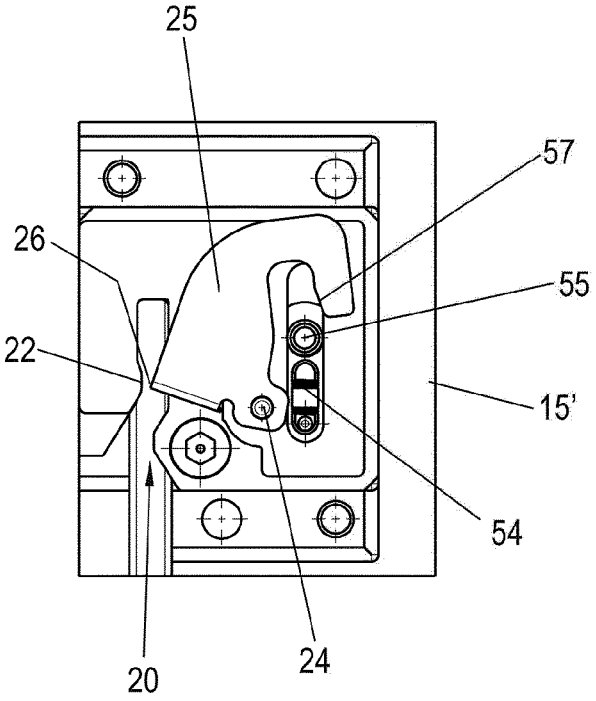
Figure 12C:
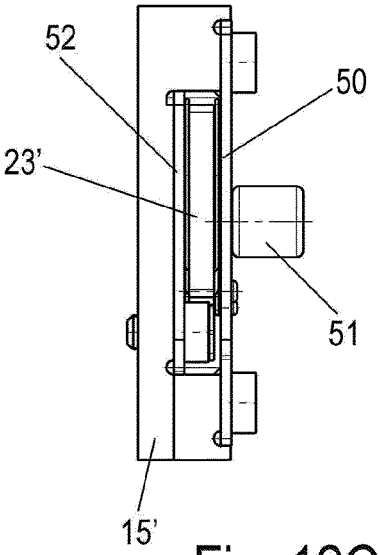

In FIGS. 12A to 12C, the device 10" is shown in the mounted position. The slide 51 can be moved along the elongated holes 53 against the force of the spring 54, wherein the slide then acts on the arm 57 of the clamping lever in order to rotate it clockwise, so that a holding part 12, which is fixed in a force-locked manner between the side wall 22 and the contact 26, can be unlocked. Other means for unlocking the clamping lever 25 can also be provided.

In the exemplary embodiment shown, both the clamping lever 25 and the fastening part 23 consist of metal, in particular of a steel sheet. As a result, particularly high holding forces can be applied to the likewise metallic holding part 12.

LIST OF REFERENCE NUMERALS

1 A piece of furniture
2 Furniture body
3 Pull-out guide
4 Drawer
5 Rail
6 Front panel
7 Bottom
8 Tab
10, 10' Device
11 Device
12 Holding part
13 Knurled nut
14 Threaded bolt
15 Housing
16 Fastening means
17 Slide
18 Device
19 Knurled nut
20 Receptacle
22 Side wall
23 Fastening part
24 Pivot
25 Clamping lever
26 Contact surface
27 Arm
28 Bolt
39 Gap
30 Spring
31 Arm

32 Spring
33 Receptacle
34 Guide
35 Receptacle
40 Threaded bolt
41 Threaded bore
50 Plate
51 Slide
52 Plate
53 Elongated hole
54 Spring
57 Actuating arm

The invention claimed is:

1. A device for fixing a push element in the form of a drawer (4) to a rail (5) of a pull-out guide (3), comprising a clamping mechanism with a receptacle (20), into which a web-shaped holding part (12) can be inserted, wherein a self-locking clamping lever (25) is provided on the receptacle (20), by means of which the holding part (12) is secured in a frictionally engaged manner against pulling out, and further comprising a linearly movable slide (17) configured for unlocking the clamping lever (25), by which the frictionally engaged clamping connection of the clamping lever (25) can be released from the holding part (12).

2. The device according to claim 1, wherein the clamping lever (25) is rotatably mounted about a pivot (24).

3. The device according to claim 2, wherein the clamping lever (25) rests via a linear contact surface (26) against the holding part (12), which extends parallel to the pivot (24) of the clamping lever (25).

4. The device according to claim 2, wherein the pivot (24) of the clamping lever (25) is arranged in the insertion direction in front of a contact surface (26) of the clamping lever (25) on the holding part (12).

5. The device according to claim 1, wherein the clamping lever (25) is pretensioned into the locked position.

6. The device according to claim 1, wherein the clamping lever (25) is designed as a two-armed lever and a first arm rests with a contact surface (26) against the holding part (12), and the second arm is movable via the linearly movable slide (17).

7. The device according to claim 1, wherein the holding part (12) can be secured in a stepless manner on the clamping mechanism.

8. The device according to claim 1, wherein the holding part (12) as well as a contact surface of the clamping lever (23) resting against the holding part (12) are made of metal.

9. The device according to claim 1, wherein at least one adjusting device is provided, which is configured to move the drawer (4) relative to the pull-out guide (3) in at least one spatial direction.

10. The device according to claim 1, wherein the receptacle (20) is formed on a fastening part (23) on which the clamping lever (25) is rotatably mounted.

11. The device according to claim 10, wherein the fastening part (23) is displaceably mounted on or in a housing (15).

12. The device according to claim 11, wherein the fastening part (23) is movable relative to the housing (15) via a device (19, 40) for lateral adjustment.

13. The device according to claim 1, wherein the holding part (12) or the clamping mechanism is configured to be arranged on a front-side region of the drawer (4).

14. A piece of furniture (1) having a furniture body (2) and at least one drawer (4) which is movably held on the furniture body (2) via two pull-out guides (3), and at least one of the pull-out guides (3) is connected to the drawer (4) via a device according to claim 1.

15. A method for fixing a push element in the form of a drawer (4) to a rail (5) of a pull-out guide (3), comprising a clamping mechanism with a receptacle (20), into which a web-shaped holding part (12) can be inserted, wherein a self-locking clamping lever (25) is provided on the receptacle (20), by means of which the holding part (12) is secured in a frictionally engaged manner against pulling out, wherein the holding part (12), when loaded in the pull-out direction, also increases the generated clamping force of the clamping lever (25) with rising load and wherein the clamping lever is unlocked by a linearly movable slide (17), by which the frictionally engaged clamping connection of the clamping lever (25) can be released from the holding part (12).

* * * * *